US007824215B2

(12) United States Patent
Islam et al.

(10) Patent No.: US 7,824,215 B2
(45) Date of Patent: Nov. 2, 2010

(54) AXIAL COMPRESSION COAXIAL CONNECTOR WITH GRIP SURFACES

(75) Inventors: Nahid Islam, Westmont, IL (US); Jeffrey Paynter, Momence, IL (US)

(73) Assignee: Andrew LLC, Hickory, NC (US)

( * ) Notice: Subject to any disclaimer, the term of this patent is extended or adjusted under 35 U.S.C. 154(b) by 107 days.

(21) Appl. No.: 12/264,931

(22) Filed: Nov. 5, 2008

(65) Prior Publication Data

US 2010/0112852 A1 May 6, 2010

(51) Int. Cl.
*H01R 9/05* (2006.01)

(52) U.S. Cl. ..... 439/578

(58) Field of Classification Search ..... 439/578
See application file for complete search history.

(56) References Cited

U.S. PATENT DOCUMENTS

| | | | | |
|---|---|---|---|---|
| 3,040,288 | A | 6/1962 | Elden et al. | |
| 3,671,926 | A | 6/1972 | Nepovim | |
| 3,744,011 | A | 7/1973 | Blanchenot | |
| 3,757,279 | A | 9/1973 | Winston | |
| 3,761,870 | A | 9/1973 | Drezin et al. | |
| 3,963,320 | A * | 6/1976 | Spinner | 439/584 |
| 4,923,412 | A | 5/1990 | Morris | |
| 5,137,470 | A * | 8/1992 | Doles | 439/578 |
| 5,267,877 | A | 12/1993 | Scannelli et al. | |
| 5,352,134 | A | 10/1994 | Jacobsen et al. | |
| 5,795,188 | A | 8/1998 | Harwath | |
| 6,019,636 | A | 2/2000 | Langham | |
| 6,808,415 | B1 | 10/2004 | Montena | |
| 6,848,939 | B2 | 2/2005 | Stirling | |
| 6,848,941 | B2 | 2/2005 | Wlos et al. | |
| 6,939,169 | B2 | 9/2005 | Islam | |
| 7,008,264 | B2 | 3/2006 | Wild | |
| 7,011,546 | B2 | 3/2006 | Vaccaro | |
| 7,156,696 | B1 | 1/2007 | Montena | |
| 7,329,149 | B2 | 2/2008 | Montena | |
| 7,335,059 | B2 | 2/2008 | Vaccaro | |
| 2005/0277330 | A1 * | 12/2005 | Kisling et al. | 439/578 |

OTHER PUBLICATIONS

European Search Report, counterpart EPO application # 09013357.0-1231, issued Jan. 26, 2010. European Patent Office, The Hague, Netherlands.

* cited by examiner

*Primary Examiner*—James Harvey
*Assistant Examiner*—Vanessa Girardi
(74) *Attorney, Agent, or Firm*—Babcock IP, PLLC

(57) ABSTRACT

A coaxial connector with a connector body is provided with a connector body bore, an annular ramp surface proximate the cable end of the connector body and a connector body mounting surface proximate the cable end of the connector body. A back body is provided with a back body bore and a back body mounting surface proximate the connector end of the back body, the back body mounting surface dimensioned to couple with the connector body mounting surface via axial compression. A surface grip on an outer conductor section of the back body bore is dimensioned to grip an outer diameter of the outer conductor, whereby the outer conductor is retained within the back body bore during the axial compression. The surface grip may be applied, for example, as a helical burr or a grip ring with a gripping feature.

18 Claims, 8 Drawing Sheets

AXIAL COMPRESSION COAXIAL CONNECTOR WITH GRIP SURFACES

BACKGROUND

1. Field of the Invention

This invention relates to electrical cable connectors. More particularly, the invention relates to a coaxial cable connector for multiple coaxial cable configurations, installable via axial compression.

2. Description of Related Art

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling nut. Representative of this technology is commonly owned U.S. Pat. No. 5,795,188 issued Aug. 18, 1998 to Harwath.

Threaded coupling surfaces between the body and the coupling nut of U.S. Pat. No. 5,795,188 and similarly configured prior coaxial connectors significantly increase manufacturing costs and installation time requirements. Another drawback is the requirement for a separate cable end flaring operation during installation, which retains the cable within the connector body during threading. Further, care must be taken at the final threading procedure and/or additional connector element(s) added to avoid damaging the flared end portion of the coaxial cable outer conductor that is clamped between the body and the coupling nut to form a secure electrical connection between the outer conductor and the coaxial cable.

Prior axial compression connectors for helical corrugation coaxial cable(s), for example as described in commonly owned U.S. Pat. No. 6,939,169 issued Sep. 6, 2005 to Islam et al, hereby incorporated by reference in the entirety, feature an inner body bore formed with corrugation mating features that enable the helically corrugated outer conductor of the coaxial cable to be threaded into the connector body along the corrugation troughs, longitudinally retaining the coaxial cable within the connector body as axial compression is applied to permanently retain the cable/make the electrical interconnection. However, the helical corrugation mating features of the connector are unusable with annular corrugated and smooth outer conductor coaxial cables and must be formed to mate with a specific helical corrugation, number of leads, depth and pitch configuration, which limits the use of each connector configuration to use with a specific helically corrugated coaxial cable.

Competition in the coaxial cable connector market has focused attention on improving electrical performance and minimization of overall costs, including materials and inventory costs, training requirements for installation personnel, reduction of dedicated installation tooling and the total number of required installation steps and/or operations. Therefore, it is an object of the invention to provide a coaxial connector that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has analyzed available solid outer conductor leading edge clamping coaxial connectors and recognized the drawbacks of threaded inter-body connection(s), manual flaring installation step requirements and cable corrugation specific connector designs.

Figure 1:
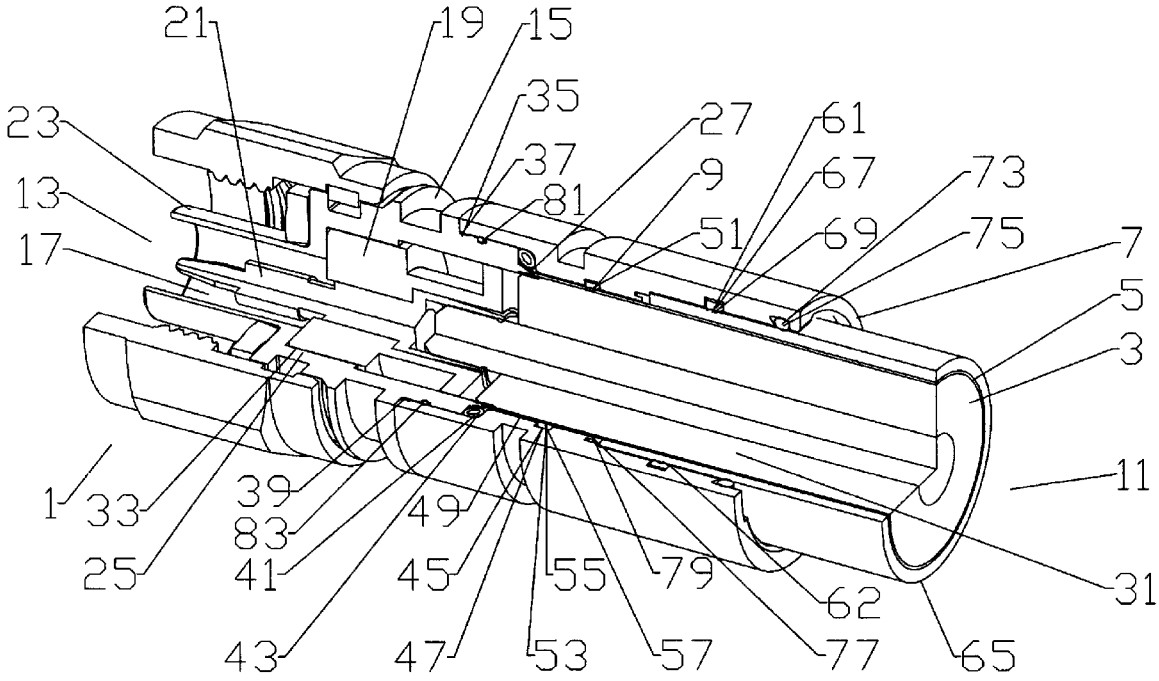
FIG. 1 is a schematic isometric 45 degree cutaway view of a first exemplary embodiment of a coaxial connector mounted on a portion of coaxial cable.
Figure 2:
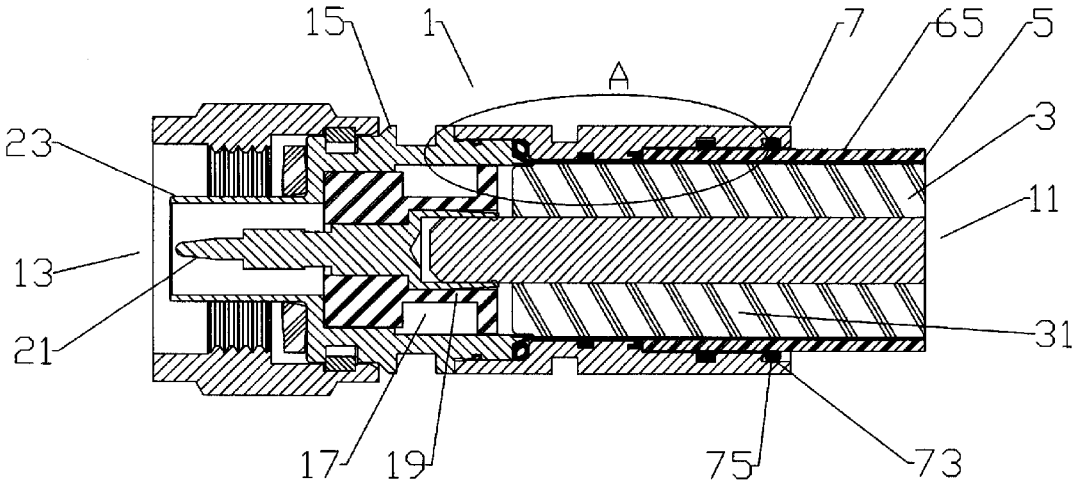
FIG. 2 is a schematic cross-section side view of FIG. 1.
Figure 3:
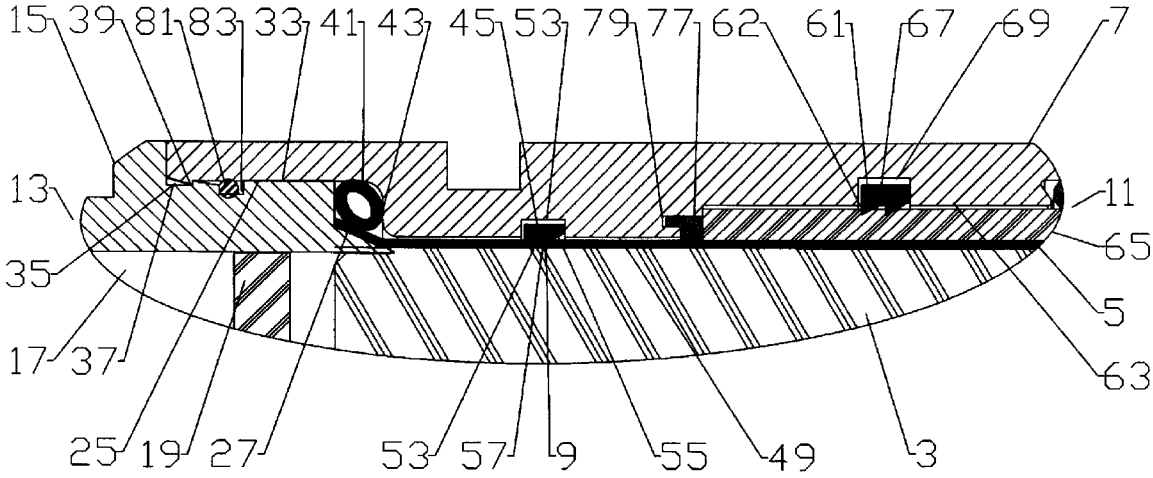
FIG. 3 is a close-up schematic view of area A of FIG. 2.

As shown in a first exemplary embodiment in FIGS. 1-3, a coaxial connector 1 according to the invention retains the outer conductor 5 of the coaxial cable 3 within the back body 7 during axial compression via an outer conductor grip surface 9. Because the grip surface 9 operates upon the outer conductor 5 outer diameter surface, including the peaks of outer conductor 5 corrugations, if present, a coaxial connector 1 according to the invention may be used with a wide range of different smooth sidewall, annular corrugated and/or helical corrugated solid outer conductor coaxial cable(s) 3 sharing a common outer conductor 5 maximum outer diameter.

One skilled in the art will appreciate that the cable end 11 and the connector end 13 are descriptors used herein to clarify longitudinal locations and contacting interrelationships between the various elements of the coaxial connector 1. In addition to the identified positions in relation to adjacent elements along the coaxial connector 1 longitudinal axis, each individual element has a cable end 11 side and a connector end 13 side, i.e. the sides of the respective element that are facing the respective cable end 11 and the connector end 13 of the coaxial connector 1.

The coaxial connector 1 has a connector body 15 with a connector body bore 17. An insulator 19 seated within the connector body bore 17 supports an inner contact 21 coaxial with the connector body bore 17. A connector interface 23 at the connector end 13 may be any desired standard or proprietary connection interface.

Figure 4:
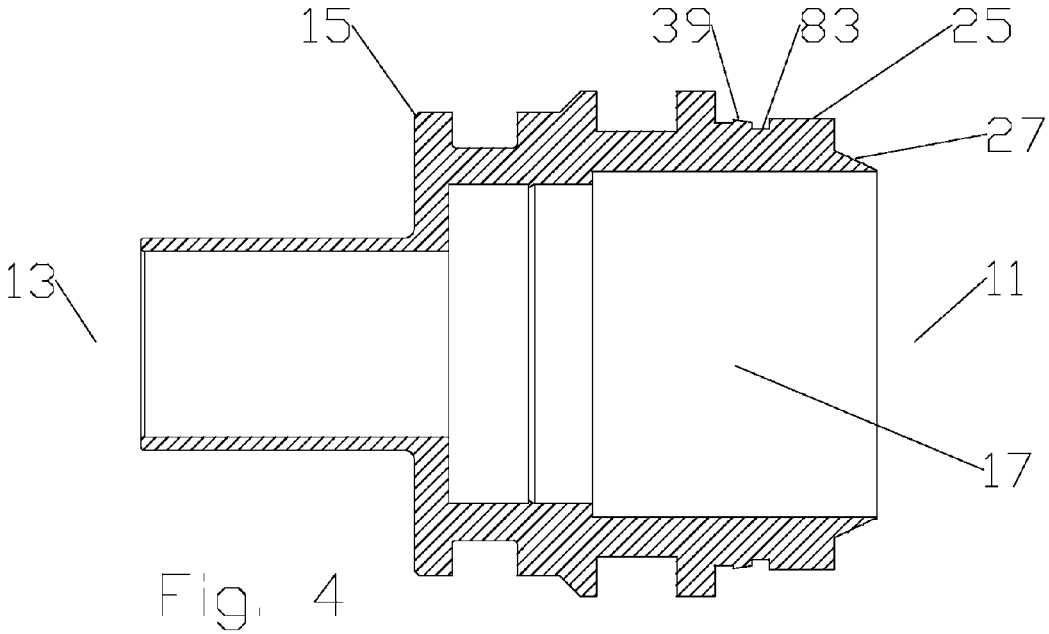
FIG. 4 is a schematic cross-section view of the connector body of FIG. 1.

As best shown in FIG. 4, the connector body 15 has a connector body mounting surface 25 and an annular ramp surface 27 proximate the cable end 11 of the connector body 15. The annular ramp surface 27 has a diameter at a cable end 11 for insertion within the outer conductor 5 of the coaxial cable 3, and is angled radially outward towards the connector end 13 to flare the leading edge of the outer conductor 5 outward as the leading edge of the outer conductor 5 is driven against the annular ramp surface 27 during installation.

Figure 5:
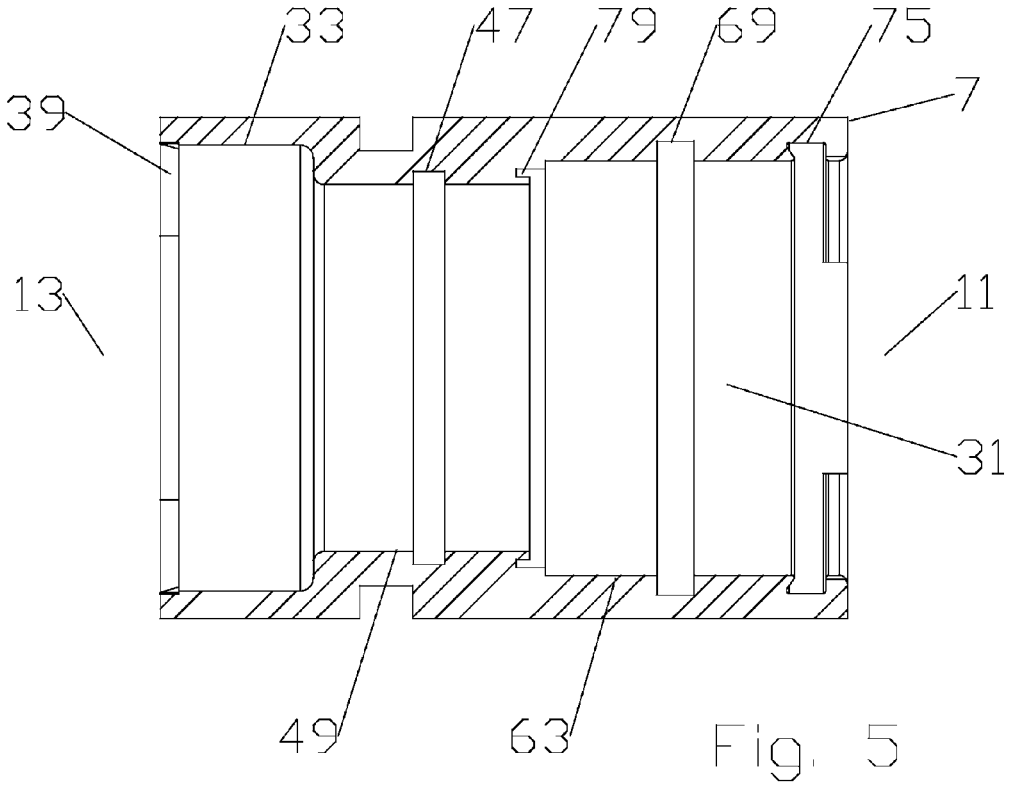
FIG. 5 is a schematic cross-section view of the back body of FIG. 1.

As best shown in FIG. 5, a back body 7 has a back body bore 31. A back body mounting surface 33 proximate the connector end 13 of the back body 7 is dimensioned to couple with the connector body mounting surface 25 via axial compression. As the back body 7 is not in the electrical path of the outer conductor 5 across the coaxial connector 1, the back body 7 may be cost-efficiently formed via injection molding using a polymer material.

In the present embodiment, the connector body mounting surface 25 is a cylindrical outer diameter surface, dimensioned to insert within the back body mounting surface 33 which is provided as a portion of the back body bore 31 at the connector end 13. The connector body mounting surface 25 and the back body mounting surface 33 may be dimensioned relative to one another to create an interference fit between them. Also and/or alternatively, an inter-surface retaining feature 35, for example a retaining groove 37 and a corresponding annular retaining barb 39 may be applied to the respective connector and back body mounting surface(s) 25,33 arranged to engage and interlock together when the back body mounting surface 33 overlaps the connector body mounting surface 25 by a desired distance corresponding to a clamping engagement of the leading edge of the outer conductor 5 against the ramp surface 27. The present embodiment is arranged with the back body mounting surface 33 overlapping the connector body mounting surface 25. One skilled in the art will appreciate that in alternative embodiments the connector body mounting surface 25 may be arranged to overlap the back body mounting surface 33.

Figure 6:
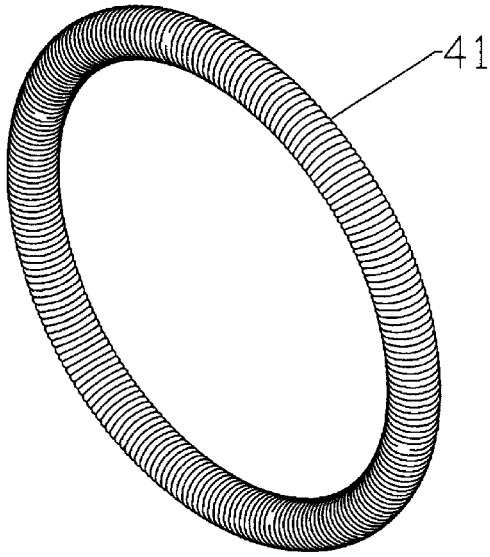
FIG. 6 is a schematic isometric view of the spring contact of FIG. 1.

As best shown in FIG. 6, a spring contact 41, for example a helical coil, may be positioned within the back body bore 31, for example at a cable end 11 of the back body mounting surface 33, seated against a contact shoulder 43. As axial compression is applied between the connector body 15 and the back body 7, the back body 7 (via for example the contact shoulder 43 or the like) or the spring contact 41, if present, is driven into contact with the leading edge of the outer conductor 5 (which is flared against the ramp surface 27), securely clamping the outer conductor 5 between the back body 7 and the ramp surface 27 to retain the coaxial cable 3 within the coaxial connector 1 and provide a three hundred and sixty degree electrical interconnection between the outer conductor 5 and the connector body 15.

Because axial compression attachment does not have a rotation characteristic between the connector body 15 and the back body 7, as required in prior threaded attachment configuration(s), there is no shearing action applied to the flared leading edge of the outer conductor 5 as the electrical interconnection is made, eliminating the need for an increased strength characteristic in the outer conductor and/or an additional slip collar element or the like within the coaxial connector 1.

Figure 7:
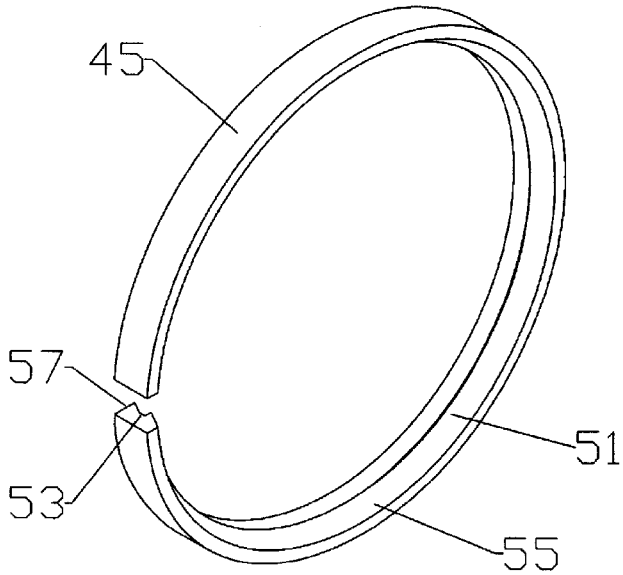
FIG. 7 is a schematic isometric view of the grip ring of FIG. 1.
Figure 8:
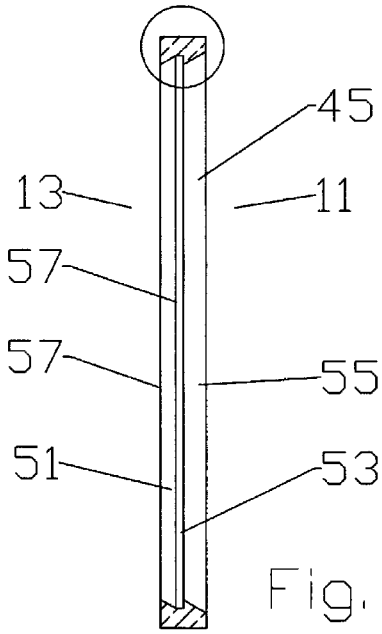
FIG. 8 is a schematic cross-section side view of the grip ring of FIG. 7.
Figure 9:
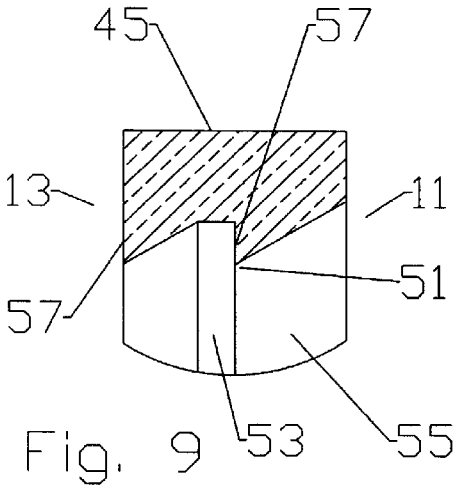
FIG. 9 is a close-up schematic view of area B of FIG. 8.

The first exemplary embodiment demonstrates the grip surface 9 as a grip ring 45 (FIGS. 7-9) seated in a grip groove 47 (FIG. 5) of an outer conductor section 49 of the back body bore 31 sidewall. The grip groove 47 may be located longitudinally within the outer conductor section 49 to position the grip ring 45 at a corrugation peak of a desired annular corrugated coaxial cable 3, when the coaxial cable 3 is inserted through the back body bore 31 a distance that locates the leading edge of the outer conductor 5 positioned to be flared by and then clamped against the ramp surface 27 when the connector body 15 is coupled to the back body 7 by axial compression.

An inner surface of the grip ring 45 has an outer conductor gripping feature 51, for example a plurality of annular barb (s), threads and/or groove(s) 53. The outer conductor gripping feature 51 preferably has a directional gripping characteristic configured to enable the outer conductor 5 to be inserted past the outer conductor gripping feature 51 from the cable end 11 towards the connector end 13, and to then grip the outer conductor 5 when tension is applied to attempt movement of the outer conductor 5 from the connector end 13 towards the cable end 11. Where the outer conductor gripping feature 51 is one or more annular barb(s) or groove(s) 53, the directional gripping characteristic may be obtained by forming the annular barb(s) or groove(s) 53 with an angled surface 55 extending from a groove bottom on the cable end 11 side towards a groove top at the connector end side 13 and a stop surface 57 opposite the angled surface 55. Thereby, an outer conductor 5 moving from the cable end 11 towards the connector end 13 will contact and slide past the angled surface(s) 55, spreading the grip ring 45 into the grip annular groove, while an outer conductor 5 moving from the connector end 13 towards the cable end 11 will encounter the stop surface 57 which will dig into the outer conductor 5 surface and thereby grip the outer conductor 5. This action can prevent further movement of the outer conductor 5 towards the cable end 11 as the grip ring 45, securely engaged with the outer conductor 5, abuts the grip groove 47, thus retaining the outer conductor 5 within the back body bore 31 after initial insertion, for example during the axial compression interconnection coaxial connector 1 to coaxial cable 3 installation. The stop surface 57 may be a vertical surface normal to the coaxial connector 1 longitudinal axis or a more aggressive counter-angled surface configured to dig into and/or pierce the outer conductor 5. To minimize costs, the grip ring 45 may be manufactured, for example via injection molding.

Figure 10:
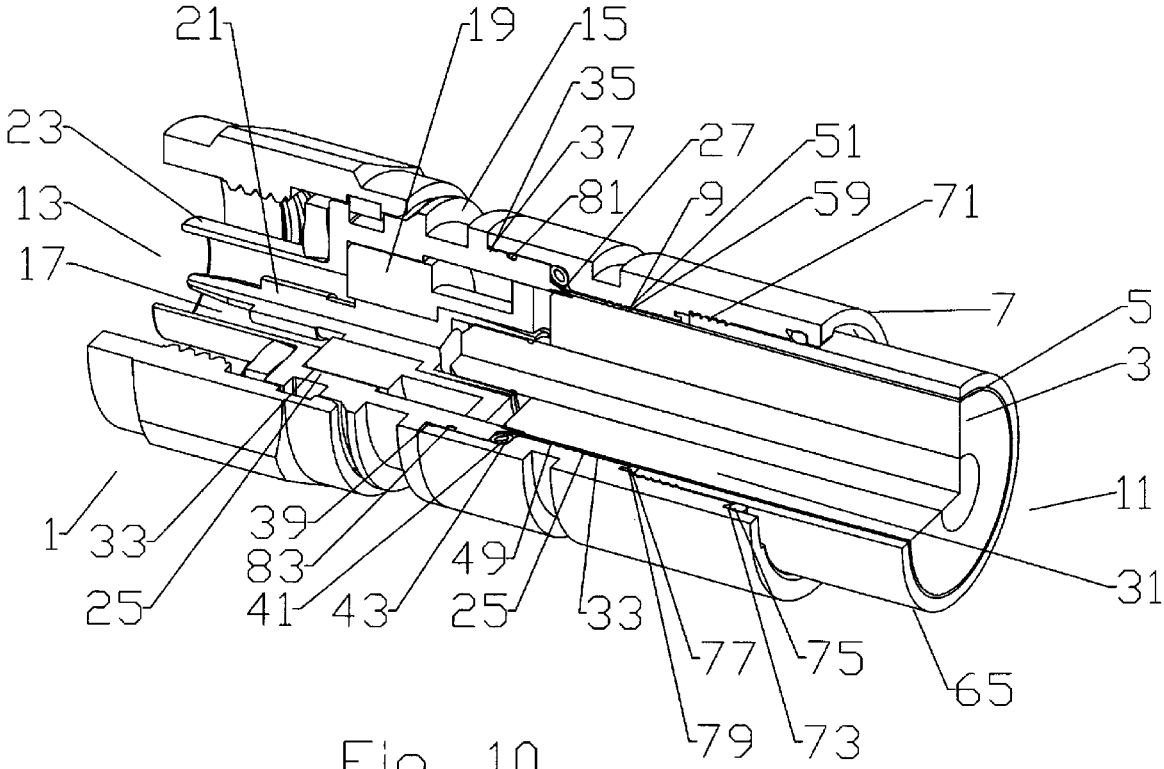
FIG. 10 is a schematic isometric 45 degree cutaway view of a second exemplary embodiment of a coaxial connector mounted on a portion of coaxial cable.
Figure 11:
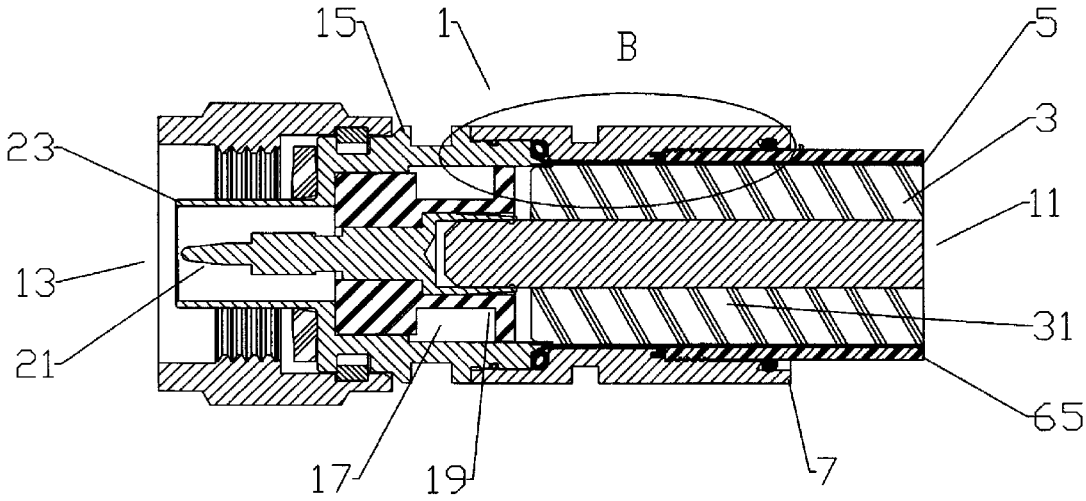
FIG. 11 is a schematic cross-section side view of FIG. 10.
Figure 12:
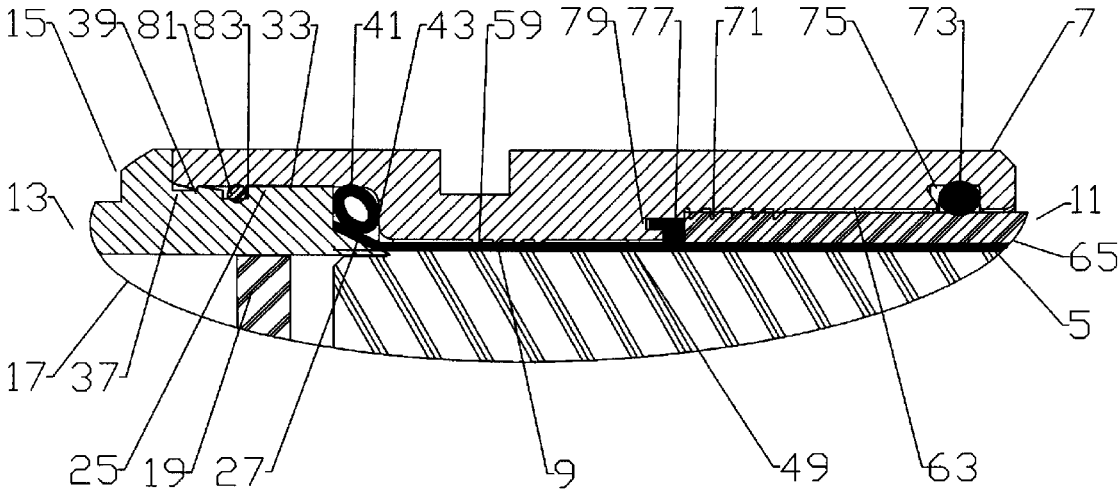
FIG. 12 is a close-up schematic view of area B of FIG. 11.
Figure 13:
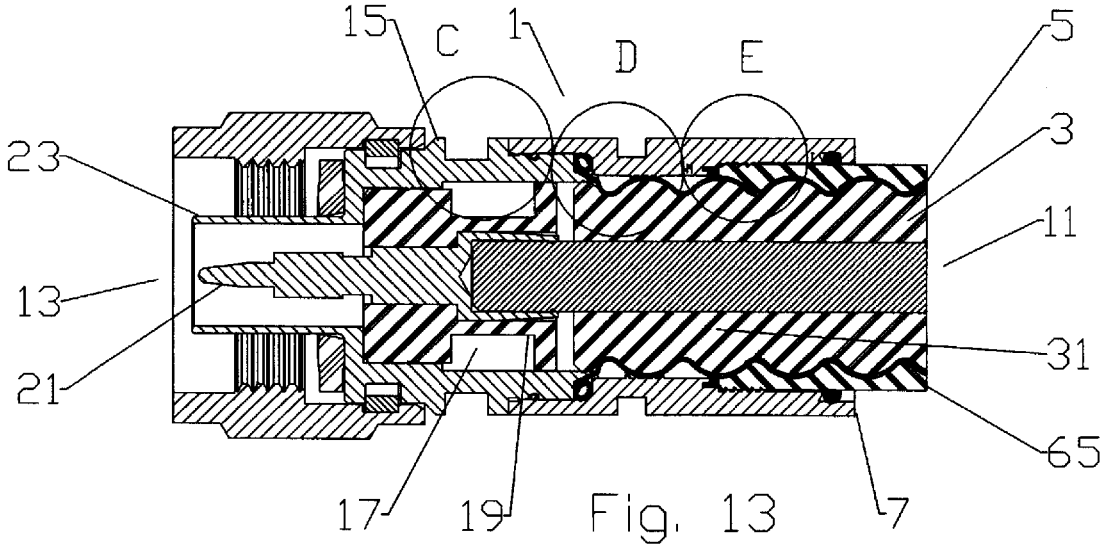
FIG. 13 is a schematic cross-section view of the second exemplary embodiment demonstrated with an annular corrugated coaxial cable.
Figure 14:
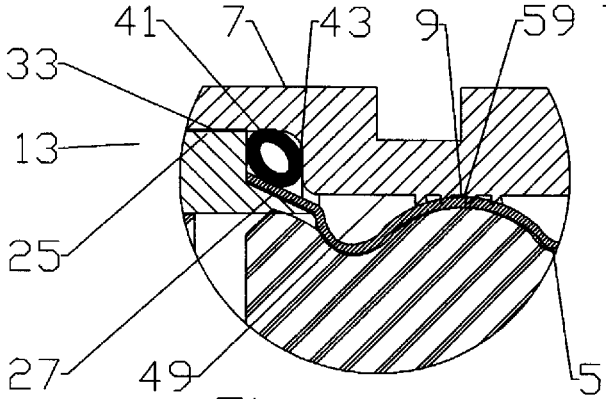
FIG. 14 is a close-up schematic view of area D of FIG. 13.
Figure 15:
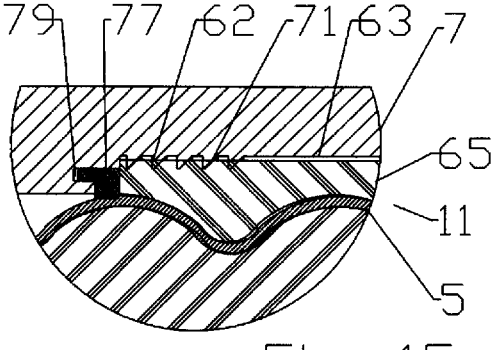
FIG. 15 is a close-up schematic view of area E of FIG. 13.
Figure 16:
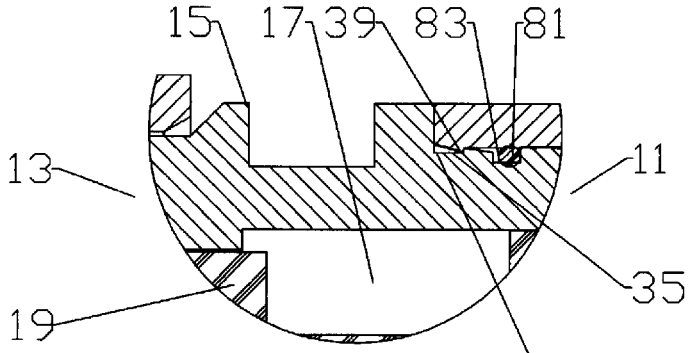
FIG. 16 is a close-up schematic view of area C of FIG. 13.

In a second exemplary embodiment, as shown for example in FIGS. 10-12 with respect to smooth wall solid outer conductor cable coaxial cable and FIGS. 13-16 with respect to annular corrugated solid outer conductor coaxial cable, the grip surface 9 is demonstrated as an outer conductor 5 surface scoring helical outer conductor burr 59 projecting inward from outer conductor section 49 of the back body bore 31 sidewall. The helical outer conductor burr 59 may be provided with a low pitch extending over the outer conductor section 49, or applied with a narrow high pitch positioned longitudinally within the outer conductor section 49 to locate the grip surface 9 at a corrugation peak of a desired annular corrugated coaxial cable 3, when the coaxial cable 3 is inserted through the back body bore 31 a distance that locates the leading edge of the outer conductor 5 positioned to be flared by and then clamped against the ramp surface 27 when the connector body 15 is coupled to the back body 7 by axial compression.

To insert a coaxial cable 3 past the helical outer conductor burr 59, the back body 7 is rotated relative to the coaxial cable 3 as it is inserted so that the helical outer conductor burr 59 engages and cuts into the outer diameter surface of the outer conductor 5.

In further alternative embodiments, multiple grip surface (s) 9 may be arrayed along the outer conductor section 49 to increase the contact area and thereby the strength of the interconnection.

Connectors installed in environments that experience significant thermal shocks may experience movement between the cable jacket 65 and the outer conductor 5 due to a variance between the expansion coefficient of these different materials.

To assist with gripping/stabilizing the coaxial cable 3 within the back body bore 31 during axial compression, thermal shock and/or to further stabilize and/or reinforce the coaxial cable 3 to coaxial connector 1 interconnection, a cable jacket grip 61 may also be applied. The cable jacket grip 61 is located in the back body bore 31 sidewall in a jacket section 63 of the back body bore 31, proximate the cable end 11 side. The jacket section 63 inner diameter is dimensioned to receive the coaxial cable 3 with the increased diameter of the coaxial cable jacket 65.

The cable jacket grip 61 may be applied, similar to the first exemplary embodiment grip surface 9, as a jacket grip ring 67 in a jacket grip groove 69 (FIGS. 1-3). The jacket grip ring 67 is also formed with a desired jacket gripping feature 62 similar to the outer conductor gripping feature 51 as described herein above, but gripping the cable jacket 65 instead of the outer conductor 5.

Alternatively, the cable jacket grip 61 may be applied, similar to the second exemplary embodiment grip surface 9, as a surface scoring helical jacket burr 71 projecting inward from the jacket section 63 sidewall (FIGS. 10-12).

Environmental seals may be applied to the connector body 15 and/or the back body 7 to environmentally seal the coaxial connector 1 cable interior and electrical interconnection(s). A jacket seal 73, seated in a jacket groove 75 proximate the cable end 11 of the jacket section 63 sidewall is dimensioned to project radially inward to seal against the cable jacket 65. An outer conductor seal 77, seated in an outer conductor groove 79 provided in a shoulder between the jacket section 63 and the outer conductor section 49, and open to the cable end 13, is dimensioned to project radially inward to seal against the outer conductor 5. To minimize secondary machining requirements, the jacket groove 75 may be formed with multiple open sections at the cable end 11, to enable formation of the jacket groove 75 during injection molding manufacture of the back body 7.

The cable jacket 65 may be stripped back during cable end preparation for interconnection to expose a desired length of outer conductor 5 such that when the cable jacket 65 abuts the cable end 11 of the outer conductor seal 77, the outer conductor 5 extends the desired length forward with respect to the back body 7 for interconnection with the connector body 15. Further, as the grip surface 9 takes hold of the outer conductor 5, pressure by the leading edge of the cable jacket 65 upon the cable end 11 of the outer conductor seal 77 compresses the outer conductor seal 77, increasing the bias of the outer conductor seal 77 against the outer conductor 5, thereby improving the seal characteristic.

A coupling surface seal 81 may also be included, for example located in a coupling surface groove 83 provided in the back body mounting surface 33 or the connector body mounting surface 25, to seal between the back body mounting surface 33 and the connector body mounting surface 25.

One skilled in the art will appreciate the several significant improvements realized via the present invention. The axial compression configuration of a coaxial connector 1 eliminates the requirement for machining threaded surfaces between the connector body 15 and the back body 7, significantly simplifying manufacturing installation. The prior manual outer conductor 5 leading edge flaring operation is eliminated as the coupling via the grip surface 9 between the coaxial cable 3 and back body 7 secures the outer conductor to be driven against and flared by the ramp surface 27 during the application of the interconnecting axial compression. Because the grip surface 9 operates upon an outer diameter of the outer conductor 5 and/or corrugation peak(s) (as demonstrated in FIGS. 13-18), a single embodiment of the coaxial connector 1 may be used with a wide range of coaxial cable(s) 3 with a common outer conductor 5 maximum outer diameter, including smooth wall, annular and helical corrugation coaxial cable 3 configurations.

Further, the coaxial cable 3 may be secured within the coaxial connector 1 at three or more locations (leading edge of the outer conductor 5 clamped to ramp surface 27, gripped by grip surface(s) 9 around the outer conductor 5 outer diameter and gripped by cable jacket 65 via the jacket gripping feature 62), providing significant improvements to the tensile and rotational torque interconnection strength and the dynamic inter-modulation distortion characteristics of the interconnection for example during cable flexure and/or interconnection vibration.

Figure 17:
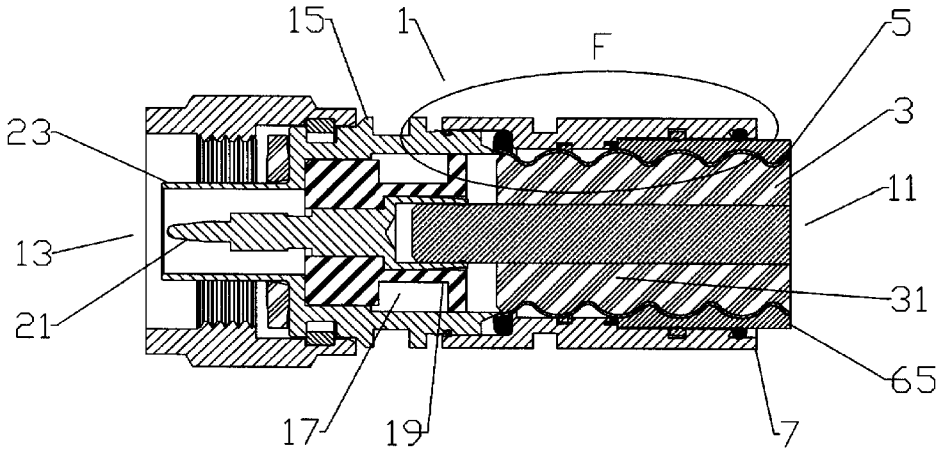
FIG. 17 is a schematic cross-section view of the first exemplary embodiment demonstrated with an annular corrugated coaxial cable, positioned for application of axial compression.
Figure 18:
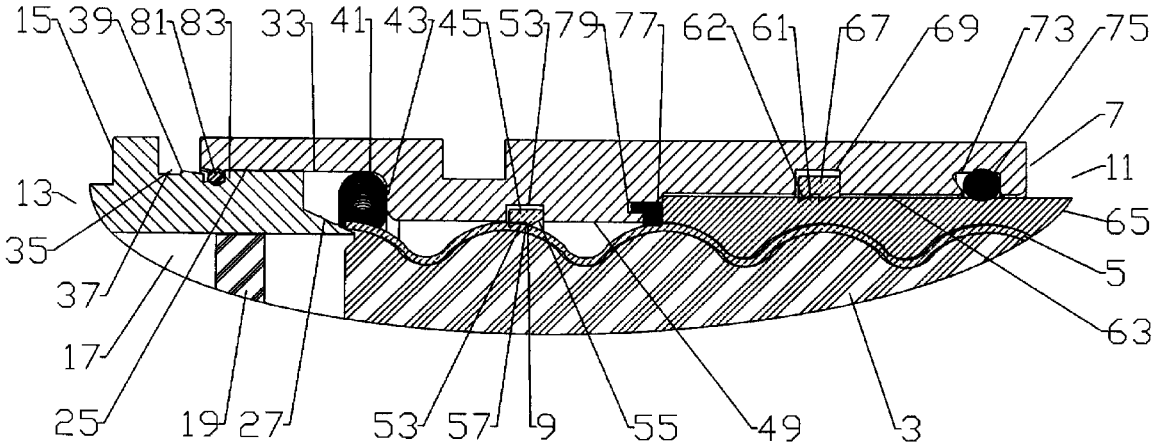
FIG. 18 is a close-up schematic view of area F of FIG. 17.

One skilled in the art will appreciate the greatly simplified training requirements, skill level and/or task focus of the installer required to terminate coaxial cables with a coaxial connector 1 according to the invention. A cable to connector interconnection according to the invention is performed quickly and with a high degree of precision in three steps. First, the end of the coaxial cable 1 is cut/stripped to expose desired lengths of the coaxial cable 3 conductors. Second, the end of the coaxial cable 1 is inserted into the back body bore 31 until the leading edge of the cable jacket 65 bottoms against the outer conductor seal 77 (FIGS. 17-18). Finally, axial compression is applied, for example with a common compression hand tool.

Table of Parts

| | |
|---|---|
| 1 | coaxial connector |
| 3 | coaxial cable |
| 5 | outer conductor |
| 7 | back body |
| 9 | grip surface |
| 11 | cable end |
| 13 | connector end |
| 15 | connector body |
| 17 | connector body bore |
| 19 | insulator |
| 21 | inner contact |
| 23 | connector interface |
| 25 | connector body mounting surface |
| 27 | ramp surface |
| 31 | back body bore |
| 33 | back body mounting surface |
| 35 | inter-surface retaining feature |
| 37 | retaining groove |
| 39 | retaining barb |
| 41 | spring contact |
| 43 | contact shoulder |
| 45 | grip ring |
| 47 | grip groove |
| 49 | outer conductor section |
| 51 | outer conductor gripping feature |
| 53 | groove |
| 55 | angled surface |
| 57 | stop surface |

-continued

| Table of Parts | |
|---|---|
| 59 | helical outer conductor burr |
| 61 | cable jacket grip |
| 62 | jacket gripping feature |
| 63 | jacket section |
| 65 | cable jacket |
| 67 | jacket grip ring |
| 69 | jacket grip groove |
| 71 | helical jacket burr |
| 73 | jacket seal |
| 75 | jacket groove |
| 77 | outer conductor seal |
| 79 | outer conductor groove |
| 81 | coupling surface seal |
| 83 | coupling surface groove |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial connector with a connector end and a cable end for coupling with a coaxial cable with a solid outer conductor, the connector comprising:

a connector body provided with a connector body bore;

an annular ramp surface proximate the cable end of the connector body;

a connector body mounting surface proximate the cable end of the connector body;

a back body provided with a back body bore;

a back body mounting surface proximate the connector end of the back body, the back body mounting surface dimensioned to couple with the connector body mounting surface via axial compression;

a grip ring seated in a grip groove formed within the back body bore proximate an outer conductor section of the back body bore; the grip ring provided with an outer conductor gripping feature dimensioned to grip an outer diameter of the outer conductor the gripping feature provided with an angled surface enabling passage of the outer conductor from the cable end to the connector end but gripping the outer conductor when outer conductor tension is applied towards the cable end, whereby the outer conductor is retained within the back body bore during the axial compression.

2. The connector of claim 1, further including a spring contact seated in the connector body bore, dimensioned to clamp a leading edge of the outer conductor against the ramp surface when the back body is coupled to the connector body.

3. The connector of claim 1, further including an outer conductor seal dimensioned to seal against the outer conductor, the outer conductor seal seated in an outer conductor groove open to the cable end, between the outer conductor section and a jacket section of the back body bore.

4. The connector of claim 1, further including a coupling surface seal dimensioned to seal between the connector body mounting surface and the back body mounting surface, the coupling surface seal seated in a coupling surface groove of the connector body mounting surface.

5. The connector of claim 1, further including an inter-surface retaining feature between the back body mounting surface and the connector body mounting surface.

6. The connector of claim 5, wherein the inter-surface retaining feature is a retaining groove on the connector body mounting surface dimensioned to engage a retaining barb of the back body mounting surface.

7. The connector of claim 1, further including a cable jacket grip in a jacket section of the back body bore proximate the cable end.

8. The connector of claim 7, wherein the cable jacket grip is a jacket grip ring in a jacket grip groove, an inner diameter of the jacket grip ring provided with a jacket gripping feature including an angled surface enabling passage of the jacket from the cable end to the connector end but gripping the jacket when the jacket tension is applied towards the cable end.

9. The connector of claim 7, wherein the cable jacket grip is a helical jacket burr projecting inward from the jacket section.

10. A coaxial connector with a connector end and a cable end for coupling with a coaxial cable with a solid outer conductor, the connector comprising:

a connector body provided with a connector body bore;

an annular ramp surface proximate the cable end of the connector body;

a connector body mounting surface proximate the cable end of the connector body;

a back body provided with a back body bore;

a back body mounting surface proximate the connector end of the back body, the back body mounting surface dimensioned to couple with the connector body mounting surface via axial compression;

a surface grip on an outer conductor section of the back body bore dimensioned to grip an outer diameter of the outer conductor, whereby the outer conductor is retained within the back body bore during the axial compression; and the grip surface is located longitudinally in the outer conductor section to grip a corrugation peak of the outer conductor.

11. A coaxial connector with a connector end and a cable end for coupling with a coaxial cable with a solid outer conductor and an outer jacket, the connector comprising:

a connector body provided with a connector body bore;

an annular ramp surface proximate the cable end of the connector body;

a connector body mounting surface proximate the cable end of the connector body;

a back body provided with a back body bore;

a back body mounting surface proximate the connector end of the back body, the back body mounting surface dimensioned to couple with the connector body mounting surface via axial compression;

a grip ring seated in a grip groove formed within the back body bore proximate an outer conductor section of the back body bore;

an inner diameter of the grip ring provided with an outer conductor gripping feature including an angled surface enabling passage of the outer conductor within the back body bore from the cable end to the connector end but gripping the outer conductor when outer conductor tension is applied towards the cable end; and a cable jacket grip in a jacket section of the back body bore proximate the cable end;

the cable jacket grip provided with a jacket gripping feature including an angled surface enabling passage of the jacket within the back body bore from the cable end towards the connector end but gripping the jacket when outer conductor tension is applied towards the cable end.

12. The connector of claim 11, further including an outer conductor seal dimensioned to seal against the outer conductor, the outer conductor seal seated in an outer conductor groove open to the cable end, between the outer conductor section and the jacket section.

13. The connector of claim 11, further including an inter-surface retaining feature between the back body mounting surface and the connector body mounting surface.

14. The connector of claim 11, further including a jacket seal dimensioned to seal against the jacket, the jacket seal seated in conductor a jacket groove.

15. A coaxial connector with a connector end and a cable end for coupling with a coaxial cable with a solid outer conductor, the connector comprising:

a connector body provided with a connector body bore;

an annular ramp surface proximate the cable end of the connector body;

a connector body mounting surface proximate the cable end of the connector body;

a back body provided with a back body bore;

a back body mounting surface proximate the connector end of the back body, the back body mounting surface dimensioned to couple with the connector body mounting surface via axial compression;

the back body bore forms a helical outer conductor burr projecting inward from an outer conductor section of the back body bore dimensioned to grip an outer diameter of the outer conductor; and a helical jacket burr projecting inward from a jacket section of the back body bore between the cable end and the outer conductor section;

whereby the outer conductor and jacket are retained within the back body bore during the axial compression.

16. The connector of claim 15, further including an outer conductor seal dimensioned to seal against the outer conductor, the outer conductor seal seated in an outer conductor groove open to the cable end, between the outer conductor section and the jacket section.

17. The connector of claim 15, further including an inter-surface retaining feature between the back body mounting surface and the connector body mounting surface.

18. The connector of claim 15, further including jacket seal dimensioned to seal against the jacket, the jacket seal seated in jacket groove of the back body bore.

* * * * *